US007255577B2

(12) United States Patent
Graham et al.

(10) Patent No.: US 7,255,577 B2
(45) Date of Patent: Aug. 14, 2007

(54) PROTECTIVE COVER FOR DIMM CIRCUIT CARD

(75) Inventors: Michael Lee Graham, Rochester, MN (US); Mark Ward Hansen, Byron, MN (US); Michael Robert Rasmussen, Mazeppa, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/106,008

(22) Filed: Apr. 14, 2005

(65) Prior Publication Data

US 2006/0234541 A1 Oct. 19, 2006

(51) Int. Cl.
*H01R 12/00* (2006.01)

(52) U.S. Cl. ..... 439/76.1; 439/946

(58) Field of Classification Search ..... 439/62, 439/76.1, 731, 946

See application file for complete search history.

(56) References Cited

U.S. PATENT DOCUMENTS 4,323,979 A * 4/1982 Johnston ..... 361/684
4,981,438 A * 1/1991 Bekhiet ..... 439/76.1
5,659,459 A * 8/1997 Wakabayashi et al. ..... 361/753

* cited by examiner

*Primary Examiner*—Khiem Nguyen
(74) *Attorney, Agent, or Firm*—Joan Pennington

(57) ABSTRACT

A protective cover for a dual inline memory module (DIMM) circuit card includes a pair of cover members for substantially containing the DIMM circuit card. The cover members are secured to opposite sides of the DIMM circuit card. The pair of cover members defines a socket-receiving channel between respective printed-circuit-board (PCB) mating faces of the cover members. The cover members includes a plurality of positioning features engaging the DIMM circuit card for positioning a portion of the DIMM circuit card within the socket-receiving channel.

16 Claims, 3 Drawing Sheets

PROTECTIVE COVER FOR DIMM CIRCUIT CARD

FIELD OF THE INVENTION

The present invention relates generally to the field of circuits, and more particularly, relates to a protective cover for a dual inline memory module (DIMM) circuit card.

DESCRIPTION OF THE RELATED ART

Multiple dual inline memory module (DIMM) circuit cards often are used in a functional test process. A significant problem is that the DIMM circuit cards can be damaged in the handling process while being installed and removed from the circuit boards that require testing. For example, capacitors and resistors can be damaged or knocked off when the DIMM circuit cards are either being installed or removed from the circuit boards being tested.

Also in the field when customers or customer engineers add a DIMM circuit card to a system, the DIMM circuit card can be damaged during the installation process.

Often the damaged DIMM circuit cards are replaced with new DIMM circuit cards. The cost of replacing damaged DIMM circuit cards results in a significant expense.

A need exists for an effective mechanism for protecting dual inline memory module (DIMM) circuit cards, particularly when used in a functional test process and for a field installation.

SUMMARY OF THE INVENTION

A principal aspect of the present invention is to provide a protective cover for a memory circuit card, such as, a dual inline memory module (DIMM) circuit card. Other important aspects of the present invention are to provide such protective cover for a dual inline memory module (DIMM) circuit card substantially without negative effect and that overcome many of the disadvantages of prior art arrangements.

In brief, a protective cover is provided for a memory circuit card, such as a dual inline memory module (DIMM) circuit card. The cover includes a pair of cover members for substantially containing the DIMM circuit card. The cover members are secured to opposite sides of the DIMM circuit card. The cover members define a socket-receiving channel between a respective printed-circuit-board (PCB) mating face of the cover members. The cover members include a plurality of positioning features engaging the DIMM circuit card for positioning a portion of the DIMM circuit card within said socket-receiving channel.

In accordance with features of the invention, the cover protects the memory circuit card from being damaged during insertion and removal from an associated printed circuit board. The cover includes features for receiving and mechanically self-aligning with the memory circuit card. The cover includes features enabling efficient and effective alignment, installation, and removal of the memory circuit card from an associated printed circuit board (PCB).

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
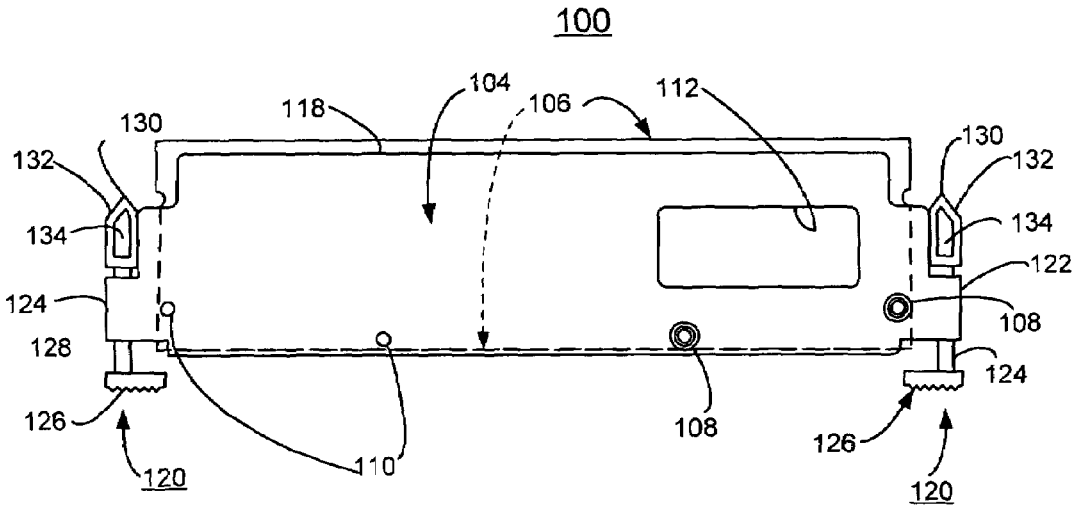
FIG. 1 is a side plan view of a cover for a dual inline memory module (DIMM) circuit card in accordance with the preferred embodiment.

Having reference now to the drawings, in FIGS. 1-4, there is shown a protective cover for a memory circuit card, such as a dual inline memory module (DIMM) circuit card in accordance with the preferred embodiment generally designated by the reference character 100. A pair of unitary, cooperating members 102, 104 forms the DIMM circuit card cover 100. The cooperating cover members 102, 104 substantially contain a DIMM circuit card 106 shown partly in dotted line in FIG. 1.

In accordance with features of the preferred embodiments, the protective cover 100 protects the DIMM circuit card from being damaged, particularly, when used in a functional test process during insertion and removal from an associated circuit board being tested. Protection provided by the DIMM circuit card cover 100 for the DIMM circuit card also is particularly advantageous for installation in the field by customers and customer engineers. Cover 100 includes features for receiving and mechanically self-aligning with the DIMM circuit card. Cover 100 includes features enabling efficient and effective alignment, installation, and removal of the DIMM circuit card from an associated printed circuit board (PCB) being tested. Cover 100 enables viewing a barcode carried by the DIMM circuit card.

DIMM circuit card cover 100 include a pair of cooperating members 102, 104 that are placed over the DIMM circuit card 106 and are accurately aligned with and are secured to opposite sides of the DIMM circuit card 106 by a plurality of screws 108 received within a plurality of respective aligned openings 110 within the mating members 102, 104 and the DIMM circuit card 106.

One of the mating members 102, 104 defining the cover 100, such as, member 104, as shown in FIG. 1, includes a window 112 to enable viewing a barcode carried by the DIMM circuit card 106.

Figure 2:
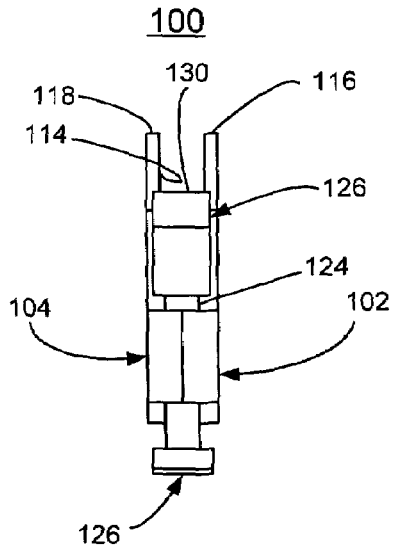
FIG. 2 is another side view of the cover for a dual inline memory module (DIMM) circuit card of FIG. 1 in accordance with the preferred embodiment.

Having reference now to FIGS. 1 and 2, DIMM circuit card cover 100 includes a socket-receiving channel 114 defined between a respective PCB mating face 116, 118 of the pair of cover members 102, 104.

A conventional DIMM circuit card socket or connector (not shown) used for electrical and mechanical connection with a DIMM circuit card 106 is carried by an associated PCB (not shown). This conventional DIMM circuit card connector is received within the socket-receiving channel 114 defined by DIMM cover 100 in mating engagement with the DIMM circuit card 106.

DIMM cover 100 includes a pair of latch-engaging mechanisms generally designated by the reference character 120 for aligning and positioning with the PCB connector provided for mating engagement with the DIMM circuit card 106. The respective latch-engaging mechanisms 120 are located near opposite ends 122, 124 of the DIMM circuit card cover 100.

Each latch-engaging mechanism 120 includes a latch button 126 carried by a support member or post 128. An end point 130 of an opposed tapered member 132 carried by the support member 128 engages a DIMM latch (not shown) supported by the associated PCB for aligning and positioning the DIMM circuit card cover 100 with the PCB DIMM circuit card connector. A recess 134 in the tapered member 132 is provided to facilitate a molding process for forming the cooperating members 102, 104.

The latch-engaging mechanisms 120 are provided on the DIMM circuit card cover 100 to assist in both accurate alignment and positioning for installation and easy removal of the DIMM circuit card 106 for the associated PCB. Pushing against the latch buttons 126 on the DIMM circuit card cover 100 pushes down on the DIMM latches supported by the associated PCB to release and remove the DIMM circuit card 106 from the PCB.

Figure 4:
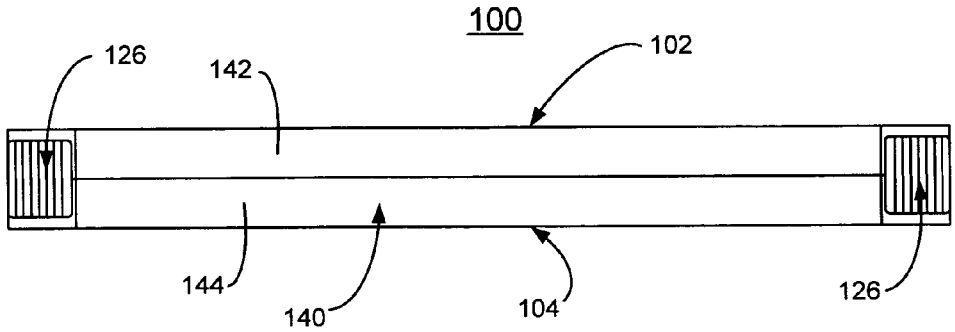
FIGS. 3 and 4 are respective opposed end plan views of the cover for a dual inline memory module (DIMM) circuit card of FIG. 1 in accordance with the preferred embodiment.
Figure 3:
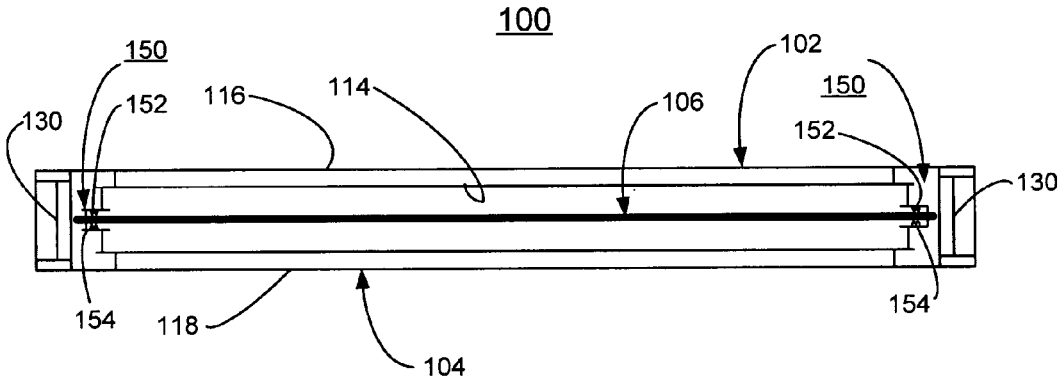

Having reference now to FIGS. 3 and 4, DIMM circuit card cover 100 includes a closed distal end 140 located at the opposite end from the PCB mating face of the cover that defines socket-receiving channel 114. Cover members 102, 104 include a respective ledge 142, 144 defining the closed distal end 140 of the DIMM circuit card cover 100. The respective ledges 142, 144 of members 102, 104 are provided in mating engagement when the cover members 102, 104 are secured to the DIMM circuit card 106 with the screws 108.

Referring to FIG. 3, DIMM circuit card cover 100 includes a positioning and retention mechanism generally designated by the reference character 150 for accurately positioning, aligning and retaining the DIMM circuit card 106 that extends within and outside the cover members 102, 104 for mating engagement with the PCB connector. The positioning and retention mechanism 150 includes a respective pair of gripper points 152, 154 formed inside the cover members 102, 104 near the opposite ends 122, 124 of the DIMM circuit card cover 100. The respective pairs or gripper points 152, 154 are aligned on opposite sides of the DIMM circuit card 106 and are provided in gripping engagement with the DIMM circuit card 106 when the cover members 102, 104 are secured to the DIMM circuit card 106 with the screws 108.

Each of the cover members 102, 104 are unitary molded members, for example, formed by injection molding technique. The cover members 102, 104 are formed, for example, of a selected antistatic material, such as an electrostatic discharge (ESD) plastic material. For example, a static dissipative material, such as RTP ESD 300 EM-FR can be used for the cover members 102, 104, this is a polycarbonate with 10% glass, flame retardant, with static dissipative characteristics, ESD protection, flame retardant, and easy molding.

In accordance with features of the preferred embodiments, the DIMM cover 100 also advantageously is arranged to provide electromagnetic interference (EMI) shielding for the DIMM circuit card 106 being protected from damage. The cover members 102, 104 can be formed with metal fiber or carbon fiber inserted into the cover material during the molding processes or a ferrite core material could be inserted, or molded to provide EMI shielding. For another example, the cover members 102, 104 can be formed with conductive shielding, such as RTP Polbutylene Terephthalate ESD C 1000, this is a Polybutylene Terephthalate (PBT) with ESD protection, and electrically conductive. This is a crystalline, high molecular weight polymer that has an excellent balance of properties and processing characteristics.

EMI shielding compounds provide immunity for sensitive components from incoming EMI and/or prevent excessive emissions of EMI to other susceptible equipment. Typically, they use carbon fiber, stainless steel fiber, or nickel-coated carbon fiber in a thermoplastic matrix to provide the necessary shielding. These compounds can also incorporate flame retardant additives, wear additives, reinforcements, and colorants for a custom solution to meet specific application requirements.

Figure 5:
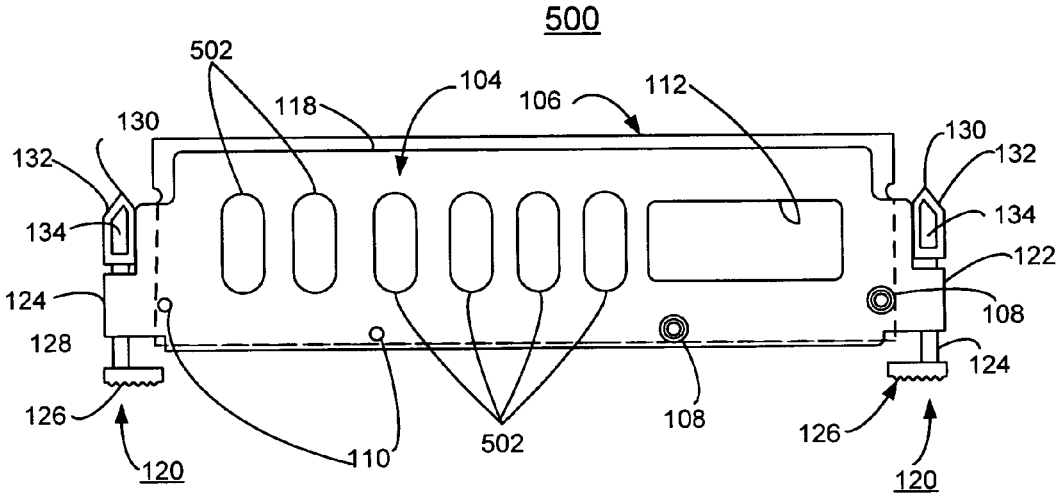
FIG. 5 is a side plan view of an alternative cover for a dual inline memory module (DIMM) circuit card in accordance with another preferred embodiment.

Referring now to FIG. 5, there is shown an alternative cover for a memory circuit card, such as the dual inline memory module (DIMM) circuit card 106, generally designated by the reference character 500 in accordance with another preferred embodiment.

In FIG. 5, the same reference characters are used for identical or similar components of protective cover 500 as used for DIMM circuit card cover 100 of FIGS. 1-4. The protective cover 500 advantageously is used in application requiring additional ventilation for the DIM circuit card 106.

The protective cover 500 includes a plurality of openings 502 preferably formed in both of the members 102, 104 to provide ventilation for the DIM circuit card 106.

Although the present invention has been described in detail with reference to certain examples thereof, it may be also embodied in other specific forms without departing from the essential spirit or attributes thereof. For example, those skilled in the art will appreciate that the threaded fasteners 108 may replaced or supplemented with snap fittings. These snap fittings may be desirable for use in embodiments where the cooperating members 102, 104 are to be permanently or semi-permanently attached to the DIMM card 106. Similarly, some embodiments may use injection molding, vapor deposition, or the like to provide additional shielding for the DIMM card 106. Moreover, the present invention may also be embodied as a tool that customer engineers can removeably clamp to the DIMM cards 106 to facilitate their removal from a computer system during service calls.

While the present invention has been described with reference to the details of the embodiments of the invention shown in the drawing, these details are not intended to limit the scope of the invention as claimed in the appended claims.

What is claimed is:

1. A protective cover for a memory circuit card comprising:

a pair of cover members for substantially containing the memory circuit card; said cover members being secured to opposite sides of the memory circuit card;

said pair of cover members defining a socket-receiving channel between a respective printed-circuit-board (PCB) mating face of said pair of cover members;

said pair of cover members including a plurality of positioning, aligning and retaining features for positioning, aligning and retaining the memory circuit card; said positioning, aligning and retaining features including gripper features engaging the memory circuit card in gripping engagement for positioning a portion of the memory circuit card within said socket-receiving channel with another portion of the memory circuit card extending outside said socket-receiving channel;

said positioning, aligning and retaining features including features receiving fasteners securing said pair of cover members to the memory circuit card; and said cover members includes latch-engaging features enabling alignment, installation, and removal of the DIMM circuit card from an associated printed circuit board (PCB).

2. A protective cover for a memory circuit card as recited in claim 1 wherein the memory circuit card includes a dual inline memory module (DIMM) circuit card.

3. A protective cover for a memory circuit card as recited in claim 2 wherein said positioning, aligning and retaining features of said pair of cover members include features for receiving and mechanically self-aligning with the DIMM circuit card.

4. A protective cover for a memory circuit card as recited in claim 3 wherein said features for receiving and mechanically self-aligning with the DIMM circuit card include plurality of respective aligned openings within said cover members and the DIMM circuit card.

5. A protective cover for a memory circuit card as recited in claim 4 wherein said cover members are secured to the DIMM circuit card by a plurality of screws received in said respective aligned openings within said cover members and the DIMM circuit card.

6. A protective cover for a memory circuit card as recited in claim 2 wherein said latch-engaging features enabling alignment, installation, and removal of the DIMM circuit card from an associated printed circuit board (PCB) include latch-engaging mechanisms for aligning, and positioning the DIMM circuit card for mating engagement with a connector on the associated PCB.

7. A protective cover for a memory circuit card as recited in claim 6 wherein said latch-engaging mechanisms for aligning, and positioning the DIMM circuit card for mating engagement with a connector on the associated PCB include a pair of support posts, each said support post having an end point of a tapered member, said end points spaced apart from the DIMM circuit card, and for engaging set locations on the associated PCB.

8. A protective cover for a memory circuit card as recited in claim 6 wherein said latch-engaging mechanisms of cover members enable removing the DIMM circuit card from the associated PCB; a latch button carried by each said support post at an opposed end from said end point; said latch button being pushed against to release and remove the DIMM circuit card from the associated PCB.

9. A protective cover for a memory circuit card as recited in claim 1 wherein each of said pair of cover members is a unitary, molded member.

10. A protective cover for a memory circuit card as recited in claim 1 wherein said cover members are formed of a selected antistatic material.

11. A protective cover for a memory circuit card as recited in claim 1 wherein said cover members are formed of a selected electrostatic discharge (ESD) plastic material.

12. A protective cover for a memory circuit card as recited in claim 1 wherein said cover members are unitary, molded members formed of a selected electrically insulative material having electrically conductive material inserted into the selected electrically insulative material.

13. A protective cover for a memory circuit card as recited in claim 12 wherein said electrically conductive material includes a selected one of metal fiber, carbon fiber, ferrite core material, stainless steel fiber, and nickel-coated carbon fiber.

14. A protective cover for a memory circuit card as recited in claim 2 wherein said cover members provide electromagnetic interference (EMI) shielding for the DIMM circuit card.

15. A protective cover for a memory circuit card as recited in claim 1 wherein at least one of said cover members include a plurality of openings for ventilation.

16. A protective cover for a dual inline memory module (DIMM) circuit card comprising:

a pair of cover members for substantially containing the DIMM circuit card; said cover members being secured to opposite sides of the DIMM circuit card;

said pair of cover members defining a socket-receiving channel between a respective printed-circuit-board (PCB) mating face of said pair of cover members;

said pair of cover members including a plurality of positioning features; said positioning features engaging the DIMM circuit card for positioning a portion of the memory circuit card within said socket-receiving channel said pair of cover members including a plurality of positioning, aligning and retaining features for positioning, aligning and retaining the memory circuit card; said positioning, aligning and retaining features including gripper features engaging the DIMM memory circuit card in gripping engagement for positioning a portion of the memory circuit card within said socket-receiving channel with another portion of the memory circuit card extend outside said socket-receiving channel;

said positioning, aligning and retaining features including features receiving fasteners securing said pair of cover members to the memory circuit card; and said cover members includes Latch-engaging features enabling alignment, installation, and removal of the DIMM circuit card from an associated printed circuit board (PCB).

* * * * *